US006087781A

United States Patent [19]

Leppelmeier

[11] Patent Number: 6,087,781

[45] **Date of Patent: *Jul. 11, 2000**

[54] SYSTEM FOR CONTROLLING FLUORESCENT LAMP OPERATION AND ILLUMINATION

[75] Inventor: Elton T. Leppelmeier, Highland Heights, Ohio

[73] Assignee: National Biological ETA Systems Corporation, Twinsburg, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/699,950

[22] Filed: Aug. 20, 1996

[51] Int. Cl.[7] ..... H05B 41/14

[52] U.S. Cl. ..... 315/200 A; 315/277; 315/241 S; 315/106; 315/283

[58] Field of Search ..... 315/106, 200 A, 315/241 P, 241 S, 277, 161, 246, 283, 284, 287; 340/331

[56] References Cited

U.S. PATENT DOCUMENTS 5,111,115 5/1992 Ball et al. ..... 315/239

*Primary Examiner*—Arnold Kinkead

*Attorney, Agent, or Firm*—Emerson & Associates; Roger D. Emerson; John M. Skeriotis

[57] ABSTRACT

Control circuitry causes a fluorescent lamp to flash by cycling the primary of the lamp ballast reactor at a desired cycle rate. This results in the average lamp wattage output being generally about 40% to 60% Go its normal wattage rating. This results in a correspondence reduction in lumen output. In such flashing, the intensity or light output of each flash is approximately the same as its normal, continuous light output.

19 Claims, 1 Drawing Sheet

SYSTEM FOR CONTROLLING FLUORESCENT LAMP OPERATION AND ILLUMINATION

BACKGROUND

This invention relates to the control of electric discharge lamps. More particularly, this relates to the control of a fluorescent lamp to periodically flash.

Control circuitry has been employed to cause a fluorescent lamp to flash by cycling the primary of the lamp ballast reactor at a desired cycle rate. This results in the average lamp wattage output being below its normal wattage rating, generally 40–60%. This in turn results in a corresponding reduction in lumen output. In such flashing, the intensity or light output of each flash is approximately the same as its normal continuous light output.

SUMMARY OF THE INVENTION

This invention relates to the use of lamp ballasting for operating fluorescent lamps intermittently. In intermittent or flashing operations, the fluorescent lamp is driven by a ballast or ballasts which is/are providing current and power at levels that are higher than the normal current and power required for continuous operation of the lamps. Over driving the lamp while periodically cycling the ballast secondary, i.e., power to the lamp, results in a corresponding increase in lumen output to produce higher intensity flashes than normal.

Over driving a lamp with voltage, causes a corresponding reduction in lamp life. However, this method of over driving the lamp with current does not produce a detrimental effect on lamp life. Furthermore, cycling or flashing of the lamp at a duty cycle proportional to the increase in current will produce an average power which is at or near the normal wattage rating for the lamp.

These and other objects may be accomplished by a system for controlling fluorescent lamp illumination comprising: a heating means for heating cathodes of the fluorescent lamp; a lamp ballast means, having an input adapted to receive a source of A-C power and an output coupled to the lamp, for providing power to the lamp in excess of the lamp's normal rated power; a means coupled to the output of the ballast means and to the lamp for repeatedly cycling the power on and off to the lamp, thereby causing the lamp to flash, and wherein the flashing intensity of the light output is greater than the lamp intensity under normal continuous operation.

These and other objects may also be accomplished by a system for controlling the operation of a fluorescent lamp having two cathodes, comprising: first and second ballasts, each ballast having a primary adapted for receiving a source of A-C power wherein such primaries are connected in parallel, each ballast further comprising a secondary wherein such secondaries are connected in parallel, the secondaries of the ballasts are coupled to the cathodes of the lamp, and wherein the first ballast has a power output substantially equal to that of the lamp; a flashing circuit, coupled to the secondaries of, the ballasts and the lamp, for repeatedly engaging and disengaging power to the lamp to cause the lamp to flash.

DETAILED DESCRIPTION OF THE INVENTION

Figure 1:
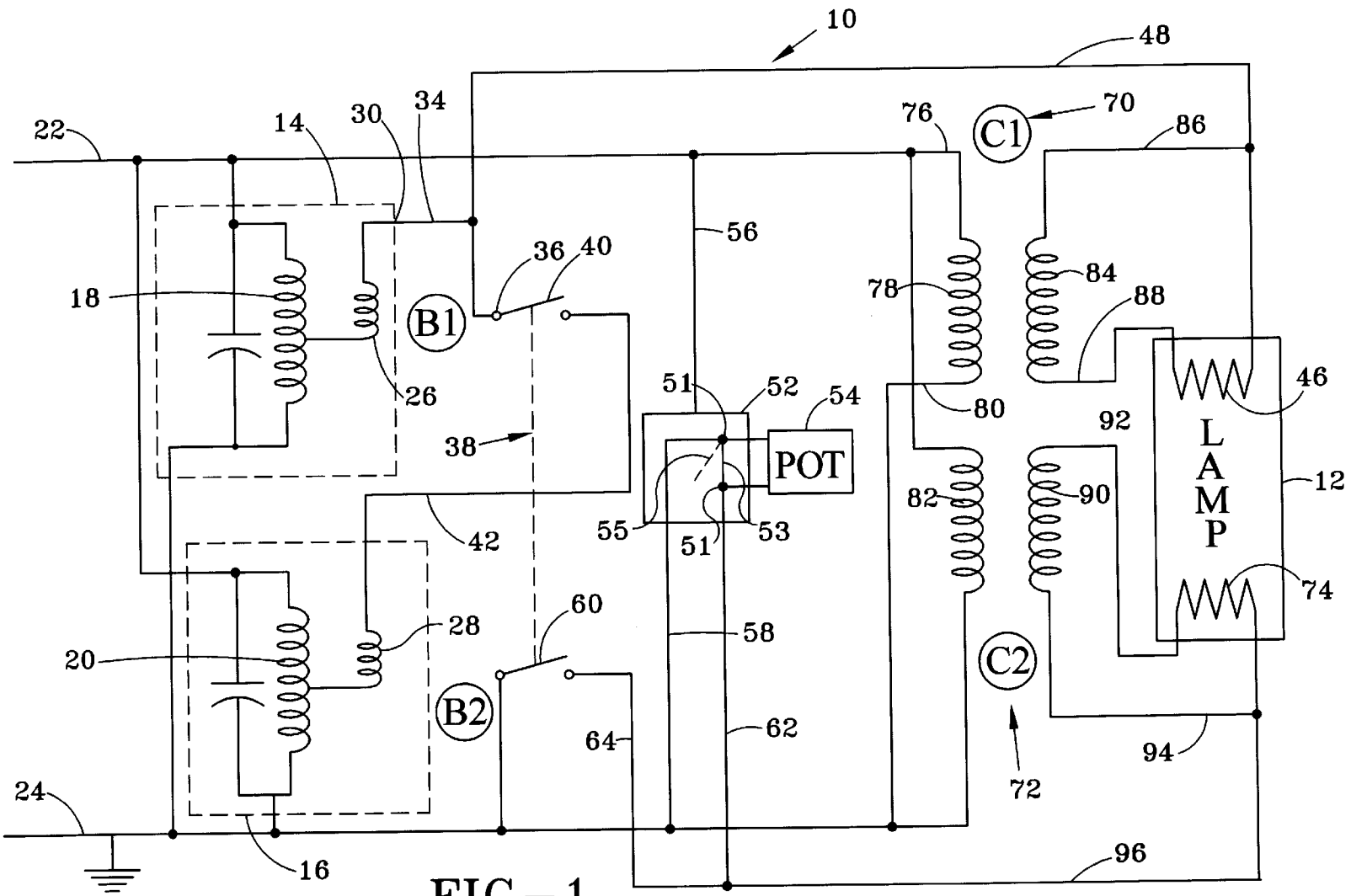
FIG. 1 a schematic wiring diagram illustrating one embodiment of the invention for operating a fluorescent lamp.

With reference to FIG. 1, there is illustrated a lamp flashing circuit, referred to generally as reference 10, for causing a fluorescent lamp 12 to operate intermittently or to flash. In general, lamp 12 may comprise an ordinary rapid start florescent lamp.

The flashing circuitry 10 includes a pair of ballasts 14,16 connected in parallel. The primary winding 18 of the first ballast 14 and the primary winding 20 of the second ballast 16 are each coupled to a source of AC power via lines 22 and 24.

The secondary winding 26 of the first ballast 14 is coupled to a double pull double throw switch 38. Specifically, the output 30 of secondary winding 26 is coupled to a pole 36 of the normally closed contact 40, of the double pull double throw switch 38, via line 34. The other pole of the normally closed contact 40 of the switch 38, is coupled to the secondary winding 28 of the second ballast 16, via line 42.

The output of the ballast 14, as well as the pole 36 of the normally closed contact 40 of switch 38, are coupled to cathode 46 of lamp 12 via line 48.

Relay flasher 52 is provided with an input device for adjusting the rate at which the flasher relay opens and closes. This may be accomplished, such as by a pot 54, a key pad, etc. The relay flasher 52 is coupled to the source of A-C power via lines 56 and 58. The output of flasher 52 is also coupled to a terminal of the normally open contact 60 of the switch 38 via lines 62 and 64. The other terminal of contact 60 is coupled to line 24, which is normally the primary neutral.

There is further provided two transformers 70,72 for providing power to cathodes 46 and 74 respectively, of the lamp 12. The first input 76 of the primary winding 78, of transformer 70 is coupled to primary line 22, while the second input 80 is coupled to primary line 24. The primary winding 78 of transformer 70 is also connected in parallel to the primary winding 82 of transformer 72. The secondary winding 84 of transformer 70 is coupled to the cathode 46 of the lamp 12 via lines 86 and 88. similarly, the secondary winding 90 of transformer 72 is coupled to the cathode 74 of lamp 12 via lines 92 and 94.

The normally opened contact 60 of switch 38 is coupled to the cathode 74 of the lamp 12 via lines 64 and 96. In operation, the output of secondary winding 84 of transformer 70 provides power to the cathode 46 of lamp 12 so that it is heated, to provide a free source of electrons, common in the operation of fluorescent lamps. Similarly, the secondary winding 90 of transformer 72 provides a source of power to heat cathode 74 of lamp 12.

The ballast 14, 16 provides the required starting voltage across cathodes 46 and 74 of lamp 12 while limiting the current to the lamp as the resistance of the lamp decreases during energization. As is well known, a ballast must provide the required starting voltage in order to draw an arc within the lamp to cause it to energize or light while also limiting the current supplied to the lamp. The ballasts 14,16 illustrated herein limit the current through the use of an auto-transformer in parallel with a capacitor. However, it is readily understood that other common type ballasts may be employed, such as those ballasted by inductance or resistance.

The ballasts 14 and 16 apply a voltage, from the secondary windings 26 and 28 to the cathode 46, via line 48 and to cathode 74 via lines 24, 58, 62 and 96 with the contacts 51 of relay flasher 52 closed. This causes the arc to be established within the lamp, thus causing the lamp to become energized.

Ballasts 14 and 16 together provide flashing power which is above the lamp is normal wattage rating. In this particular embodiment, each ballast is sized to provide power and current that is about that of the normal power and current rating of the lamp. In other words, the fluorescent lamp is intermittently operated at twice its normal power rating. If the flasher circuit operates to intermittently operate (flash) the lamp at a duty cycle in the range of about 40 to 60% of the time. This in turn, allows the lamp to operate, on average at 80 to 120% of its rated normal power during a cycle. Thus, at a 50% duty cycle, about twice the flashing intensity can be achieved at about the same average power as would be used during continuous operation.

With at last one of the ballasts rated for the continuous power requirements of the lamp, such as ballast 14, the lamp can easily be switched from flashing made to continuous operation. Actuating switch 38, causes normally closed contact 40 to open while closing normally open contact 60. This bypasses both the flashing circuitry 52, as well as ballast 6 to drive the lamp in continuous operation.

While certain representative embodiments and details have been shown for the purpose of illustrating the invention, it will be apparent to those skilled in the art that various changes and modifications may be made therein without departing from the scope of the invention. For example, other flashing power levels can be obtained by using different current/wattage rated ballasts either singly or in parallel, as long as the ballasts are capable of providing the required lamp starting and operating volts. Furthermore, the ballasts are not limited to electromagnetic ballasts, but could also be electronic ballasts.

What is claimed is:

1. A system for controlling illumination of a fluorescent lamp, comprising:

heating means for heating cathodes of the fluorescent lamp;

lamp ballast means comprising two reactive ballasts coupled in parallel, having an input adapted to receive a source of A-C power and an output coupled to the fluorescent lamp for providing power to the lamp in excess of the fluorescent lamp's normal rated power, wherein twice the normal rated lamp power is applied to the lamp via the second ballast;

means coupled to the output of the ballast means and to the fluorescent lamp for repeatedly cycling the power on and off to the fluorescent lamp, thereby causing the fluorescent lamp to flash; and, wherein the flashing intensity of the light output is greater than the fluorescent lamp's intensity under normal continuous operation.

2. The system of claim 1 wherein the means for repeatedly cycling the power includes a means for varying the rate of cycling such that the flashing rate of the fluorescent lamp is varied.

3. The system of claim 1 wherein the power of each ballast equals the power rating of the fluorescent lamp.

4. The system of claim 3 further including a switch having a first position and second position, wherein the first position engages the means for cycling the power such that the fluorescent lamp flashes and the second position disengages the means for cycling such that the fluorescent lamp operates continuously.

5. A system for controlling the operation of a fluorescent lamp having two cathodes, comprising:

whereby the system increases human output to produces higher intensity flashes without detrimental effect, first and second ballasts, each ballast having a primary adapted for receiving a source of A-C power wherein such primaries are connected in parallel, each ballast further comprising a secondary wherein such secondaries are connected in parallel, the secondaries of the ballasts are coupled to the cathodes of the lamp, and wherein the first ballast has a power output substantially equal to that of the lamp;

a flashing circuit, coupled to the secondaries of the ballasts and the lamp, for repeatedly engaging and disengaging power to the lamp to cause the lamp to flash.

6. The system of claim 5 wherein the flashing circuit varies the rate of flashing to produce a duty cycle of between 40 and 60%.

7. The system of claim 6 wherein the flashing circuit comprises a flashing relay.

8. The system of claim 5 wherein the power output of the second ballast is equal to that of the first ballast.

9. The system of claim 5 further including a switch for selectively disengaging the second ballast and the flashing circuit such that the lamp will be driven continuously by the first ballast.

10. The system of claim 8 further including a switch for selectively disengaging the second ballast and the flashing circuit such that the lamp will be driven continuously by the first ballast.

11. The system of claim 10 further including first and second transformers, the first transformer coupled to one cathode of the lamp and the second transformer coupled to another cathode of the lamp.

12. An apparatus for controlling illumination of a fluorescent lamp, comprising:

transformers for heating cathodes of said fluorescent lamp;

a ballast for ballasting said fluorescent lamp having an input adapted to receive a source of A-C power and an output coupled to said fluorescent lamp, said ballast providing power to said fluorescent lamp in excess of a normal rated power of said fluorescent lamp;

a circuit for repeatedly cycling power at a cycling rate between power on and power off to said fluorescent lamp coupled to the output of said ballast and to said fluorescent lamp, thereby causing said fluorescent lamp to flash at a flashing rate with a flashing intensity of light output which is greater than the flashing intensity of light output of said fluorescent lamp under normal continuous operation; and, additionally, cycling of the lamp at a duty cycle proportional to an increase in current will produce an average power which is at or near the normal wattage rating for the lamp.

13. The apparatus of claim 12 wherein said cycling circuit comprises varying means for varying said cycling rate such that said flashing rate of said fluorescent lamp varies.

14. The apparatus of claim 13 further comprising a switch having a first position and second position, said first position engaging said cycling circuit such that said fluorescent lamp flashes, said second position disengaging said cycling circuit such that said fluorescent lamp operates continuously.

15. An apparatus for controlling the operation of a fluorescent lamp having a first cathode and a second cathode and a normal power rating, comprising:

a first ballast and a second ballast, said first ballast having a first primary and said second ballast having a second primary adapted for receiving a source of A-C power wherein said first prior and said second primary are connected in parallel, said first ballast having a first secondary and said second ballast having a second secondary wherein said first secondary and said second secondary are connected in parallel, said first secondary and said second secondary being coupled to said first cathode and said second cathode of said fluorescent lamp, said first ballast having a power output substantially equal to said normal power rating of said fluorescent lamp;

a flashing circuit coupled to said first secondary and said second secondary, said flashing circuit repeatedly engaging and disengaging power to said fluorescent lamp and causing said fluorescent lamp to flash at a flashing rate; and, additionally, cycling of the lamp at a duty cycle proportional to an increase in current will produce an average power which is at or near the normal wattage rating for the lamp.

16. The apparatus of claim 15 wherein said flashing circuit varies said flashing rate to produce a duty cycle of between 40% and 60%.

17. The apparatus of claim 15 wherein said flashing circuit comprises a flasher relay.

18. An apparatus for controlling illumination of a fluorescent lamp, comprising:

transformers for heating cathodes of said fluorescent lamp;

a ballast for ballasting said fluorescent lamp having an input adapted to receive a source of A-C power and an output coupled to said fluorescent lamp, said ballast providing power to said fluorescent lamp in excess of a normal rated power of said fluorescent lamp;

a circuit for repeatedly cycling power at a cycling rate between power on and power off to said fluorescent lamp coupled to the output of said ballast and to said fluorescent lamp, thereby causing said fluorescent lamp to flash at a flashing rate with a flashing intensity of light output which is greater than the flashing intensity of light output of said fluorescent lamp under normal continuous operation, said circuit comprising varying means for varying said cycling rate such that said flashing rate of said fluorescent lamp varies;

additionally, cycling of the lamp at a duty cycle proportional to an increase in current will produce an average power which is at or near the normal wattage rating for the lamp.

19. An apparatus for controlling the operation of a fluorescent lamp having a first cathode and a second cathode and a normal power rating, comprising:

a first ballast and a second ballast, said first ballast having a first primary and second ballast having a second primary adapted for receiving a source of A-C power wherein said first primary and second primary are connected in parallel, said first ballast having a first secondary and said second ballast having a second secondary wherein said first secondary and said second secondary are connected in parallel, said first secondary and said second secondary being coupled to said first cathode and said second cathode of said fluorescent lamp, said first ballast having a power output substantially equal to said normal power rating of said fluorescent lamp;

a flashing circuit coupled to said first secondary and said second secondary, said flashing circuit repeatedly engaging and disengaging power to said fluorescent lamp and causing said fluorescent lamp to flash at a flashing rate; and, additionally, cycling of the lamp at a duty cycle proportional to an increase in current will produce an average power which is at or near the normal wattage rating for the lamp.

* * * * *